United States Patent [19]

Kanfer et al.

[11] Patent Number: 4,786,432

[45] Date of Patent: Nov. 22, 1988

[54] INTEGRAL DRY ABRASIVE SOAP POWDERS

[75] Inventors: Joseph S. Kanfer, Akron; James A. Monson, SilverLake Village; Lucy J. Krieger, Clinton, all of Ohio

[73] Assignee: Go-Jo Industries, Inc., Cuyahoga Falls, Ohio

[21] Appl. No.: 859,362

[22] Filed: May 5, 1986

[51] Int. Cl.[4] ..... C11D 9/20; C11D 11/04; C11D 13/00; C11D 17/06

[52] U.S. Cl. ..... 252/120; 252/128; 252/130; 252/131; 252/134; 252/155; 252/368; 252/369; 252/370; 252/542; 252/548; 252/DIG. 5; 427/220

[58] Field of Search ..... 252/111, 112, 113, 115, 252/116, 119, 120, 123, 124, 125, 128, 129, 130, 131, DIG. 5, 367, 368, 369; 427/220

[56] References Cited

U.S. PATENT DOCUMENTS

| | | | |
|---|---|---|---|
| 662,096 | 11/1900 | Schmidt | 252/123 |
| 700,602 | 5/1902 | Bamberg | 252/119 |
| 1,281,010 | 10/1918 | Hubbard | 252/123 |
| 1,362,393 | 12/1920 | Chaplin | 252/130 |
| 1,515,950 | 11/1924 | Hildenbrand | 252/119 |
| 1,612,525 | 12/1926 | Mott | 252/124 |
| 1,770,429 | 7/1930 | Reinle | 252/123 |
| 2,164,810 | 7/1939 | Flaxman | 252/119 |
| 2,455,910 | 12/1948 | Alderson | 260/23 |
| 2,581,278 | 1/1952 | Munter | 252/116 |
| 3,092,111 | 6/1963 | Saperstein | 128/355 |
| 3,196,079 | 7/1965 | Blaustein | 167/92 |
| 3,281,367 | 10/1966 | Jones et al. | 25/112 |
| 3,383,329 | 5/1968 | Bell | 252/132 |
| 3,541,581 | 11/1970 | Monson | 252/90 |
| 3,645,904 | 2/1972 | Beach | 252/89 |
| 4,064,061 | 12/1977 | Henry | 252/91 |
| 4,155,870 | 5/1979 | Jorgensen | 252/131 |
| 4,182,686 | 1/1980 | Laks | 252/119 |
| 4,240,919 | 12/1980 | Chapman | 252/95 |
| 4,263,284 | 4/1981 | Schreuder | 424/180 |
| 4,284,533 | 8/1981 | Imamura et al. | 252/542 |
| 4,397,755 | 8/1983 | Brierley et al. | 252/113 |
| 4,430,245 | 2/1984 | Beattie | 252/117 |
| 4,512,736 | 4/1985 | Wader | 432/58 |

FOREIGN PATENT DOCUMENTS

| | | | |
|---|---|---|---|
| 1289600 | 2/1969 | Fed. Rep. of Germany . | |
| 47-47282 | 11/1972 | Japan . | |
| 857 | of 1862 | United Kingdom | 252/130 |

OTHER PUBLICATIONS

Martin, Geoffrey; The Modern Soap and Detergent Industry, vol. II, Sec. IV, p. 46, published by The Technical Press Ltd, London, 1951, (TP 991 M3 1951).

Pamphlet—TETROL—Chemische Fabrik Stockhausen GmbH—date unknown.

*Fatty Acids*—Northern Regional Research Center, U.S. Department of Agriculture—pp. 585–586.

*McCutcheon's Functional Materials*—1985 North American Edition—pp. 8–9.

Pamphlet—Stockhausen—Chemische Fabrik Stockhausen GmbH—date unknown.

Perlite Technical Data Sheet No. 2–1, Perlite Institute, Inc. 1980.

Pamphlet—Basic Facts About Perlite, Perlite Institute, Inc. 1976.

*Primary Examiner*—Dennis Albrecht

*Attorney, Agent, or Firm*—Reese Taylor

[57] ABSTRACT

Integral powdered abrasive soaps are formulated by in-situ reacting on an abrasive, an acid or base component with an antipodal base or acid component. Since the acid or base component resides on the abrasive particles, the formed soap also resides on the abrasive particles and often forms a coating. The in-situ soap is a dry powder and is flowable. The abrasive can be a crushable abrasive so that, upon the application of slight pressure thereto, it breaks down into small particles and aids in cleaning.

17 Claims, No Drawings

INTEGRAL DRY ABRASIVE SOAP POWDERS

FIELD OF THE INVENTION

The present invention relates to dry or neat abrasive soaps. More specifically, the present invention relates to the formation of dry or neat powder abrasive soaps made by the in-situ reaction of an acid or base component with an antipodal component on an abrasive particle.

PRIOR ART

Heretofore, abrasive containing soaps were merely a physical admixture of an abrasive and a soap. That is, the soaps were not bonded or connected to the abrasive or formed an integral powder therewith.

U.S. Pat. No. 662,096 to Schmidt relates to a granular skin soap containing pulverized pumice-stone.

U.S. Pat. No. 1,362,393 to Chaplin relates to a soap having a combined scrubbing and adhesive initial action of a nonabrasive character and adapted to have incorporated therein an excess of alkali whereby such initial adhesive action may be gradually overcome during usage of the soap.

U.S. Pat. No. 1,770,429 to Reinle relates to a scouring soap powder made by mixing vegetable oil, caustic soda and volcanic ash.

U.S. Pat. No. 2,455,910 to Alderson relates to a method of curing ethylene polymers in the presence of a peroxy compound.

U.S. Pat. No. 3,092,111 to Sperstein et al relates to a therapeutic method for the abrasion of human skin utilizing a paste contaiing a detergent having an inorganic abrasive dispersed therein.

U.S. Pat. No. 3,196,079 to Blaustein relates to cosmetic powder compositions containing a finely divided, high density polyolefin as a substitute for talc.

U.S. Pat. No. 3,281,367 to Jones et al relates to liquid detergent compositions containing anionic detergents, fatty acid soaps, non-ionic surface active agents and a finely divided water-insoluble abrasive such as silica, felspar, pumice, keisel-guhr, emery or carborundum.

U.S. Pat. No. 3,326,807 to Guest et al relates to an opaque liquid detergent composition containing essentially a liquid synthetic detergent and an aqueous dispersion of a copolymer of styrene with at least one ethylenically unsaturated monomer such as acrylamide.

U.S. Pat. No. 3,383,320 to Bell relates to a detergent bar having a solid water soluble detergent held in a solid matrix of a sintered thermoplastic resin wherein the resin can be polypropylene, propylene-ethylene copolymer or polyethylene.

U.S. Pat. No. 3,541,581 to Monson relates to a post foaming gel.

U.S. Pat. No. 3,645,904 to Beach relates to a skin cleaner which eliminates mineral-based abrasives such as aluminum oxide, volcanic ash, and the like and substitutes therefor a resilient plastic such ass polyethylene.

U.S. Pat. No. 4,155,870 to Jorgensen reltates to a skin cleaning composition which is an oil-in-water emulsion containing one or more solvents such as isoparaffin solvents or deodorized kerosenes and water insoluble glass bubbles which aid in cleaning.

U.S. Pat. No. 4,240,919 to Chapman relates to a thixotropic abrasive liquid scouring composition having substantially no syneresis and is prepared by mixing water, an abrasive and a multivalent stearate in specific ratios.

The abrasive includes various materials such as quartz, pumice, perlite, aluminum silicate, and the like.

U.S. Pat. No. 4,263,284 to Schreuder relates to a skin cleaner composition containing various components such as a continuous oil phase, a dispersed aqueous emulsified phase, a buffer consisting essentially of lactic acid and triethanolamine, an emulsifying system conisting essentially of various mono- and diglycerides of higher natural fatty acids, glycerine, and caraghenates.

U.S. Pat. No. 4,284,533 to Imamura et al relates to a liquid abrasive cleaner containing a liquid cleanser, a hydrotrope and a nonionic surfactant.

U.S. Pat. No. 4,397,755 to Brierley et al relates to a liquid media in which particulate materials can be stably suspended. The composition also includes a small amount of a hectorite clay.

U.S. Pat. No. 4,512,736 to Wader relates to an apparatus for expanding perlite and vermiculite by injecting said particles which are entrained in a carrier gas through a burner at the bottom of a fluidized bed furnace.

An article "Basic Facts About Perlite" relates to the origin and characteristics, as well as various other properties of perlite and is published by the Perlite Institute, Inc., New York, N.Y. (1976).

Technical data sheet No. 2-1 1980, published by the Perlite Institute relates to a summary of uses of perlite.

A publication by Stockhausen, Skin Cleaning, Publication No. 9-1-K-3.0 relates to the use of various surfactants as hand cleaners. Although the Skin Cleaning publication does disclose that scrubbers can be utilized, they are evidently bound to a surfactant through some sort of a binding compound.

An integral abrasive powder soap and the in-situ formation thereof is not disclosed by the above documents.

SUMMARY OF THE INVENTION

It is therefore an aspect of the present invention to provide a soap wherein the soap is attached or connected to abrasive particles by being formulated on the particles.

It is a further aspect of the present invention to provide abrasive particles having a soap formulated thereon, as above, which is a dry or neat powder and is flowable and non-agglomerated.

It is yet a further aspect of the present invention to provide abrasive particles having a soap formulated thereon, as above, wherein the soap is made in-situ.

It is still a further aspect of the present invention to provide abrasive particles having a soap formulated thereon, as above, wherein said abrasive is crushable upon the application of mild pressure thereto.

These and other aspects of the present invention will become apparent from the following detailed description.

In general, an abrasive soap comprises the formulation of a dry or neat abrasive soap, said dry or neat abrasive soap being the in-situ reaction product of an initial precursor on abrasive particles.

DESCRIPTION OF THE PREFERRED EMBODIMENTS

Abrasive containing soaps of the present invention are desirably made in-situ, that is, formulated on abrasive particles. An integral abrasive soap is thus produced. That is, the soap is integrally attached to the abrasive particles.

By the term abrasive particles it is meant that a single individual or a plurality of particles of the same type of abrasive or of different types of abrasives are utilized. From a practical standpoint, numerous particles are generally utilized to form a sufficient amount of a cleaning material. the abrasives are generally finally divided particles and, depending on the desired end use, can be hard or mild.

Examples of hard abrasives generally include silica sand, aluminum oxide, pumice, rough (iron oxide), feldspar, silicon carbide, boron carbide, cerium oxide, quartz, garnet, and the like. Hard abrasives can loosely be defined as those compounds, either natural, mineral or synthetic which have a hardness on the Mohs scale of from about 6 to 10.

Other suitable abrasives, generally classified as mild abrasives (Mohs value of about 6 or less), include compounds such as titanium dioxide, calcium carbonate, calcium phosphate, diatomaceous earth, various forms of borax including puffed borax, perlite, raolinite, mica, tripoli, pumicite and expanded pumicite, various ground, rigid polymeric or synthetic plastics materials such as polyethylene, melamine, urea formaldehyde resins, and polyurethane foam, talc, vermiculite, water absorbent soft abrasives such as calcium silicate, aluminum silicate, and the like.

Desirable abrasives for use in the present invention include limestone (calcium carbonate), pumice, diatomaceous earth, talc, vermiculite, and various ground plastics. Perlite is a preferred mild abrasive. Perlite is a generic term for naturally occurring silicaceous volcanic rock. The density of perlite is very low and ranges from about 0.01 to about 0.5 grams and preferably from about 0.05 to about 0.07 grams per cubic centimeter. Inasmuch as perlite is mined, any geographic source is generally suitable. Perlite can be commercially obtained from Oneida Perlite Co. and Pennsylvania Perlite Co. An example of a suitable perlite is PFF-18 distributed by Pennsylvania Perlite Co. Perlite is especially desirable in that it is crushable upon the application of mild pressure thereto such as hand pressure. Thus, when utilized in a soap formation, a suitable abrasive and/or scouring action is obtained without damage to the skin.

The average size of the abrasive particles is generally dependent upon the desired end use.

With regard to personal skin care, the average particle size is generally from about 150 to about 500 microns and preferably from about 350 to about 450 microns.

With regard to hard surfaces, that is, any non living entity such as sinks and showers, tires, etc. the average particle size is generally larger than that for skin care in order to provide an effective cleaning action. It is to be undertood that the above ranges constitute the size of an average particle. Naturally, much larger and smaller particles will exist as known to those skilled in the art as well as to the literature.

The density of the abrasive is deirably low, that is, generally 0.9 grams/cc or less and preferably 0.5 grams/cc or less. Low density particles are densied in that they will float in water and are thus anti-clogging with regard to drain traps, and the like. Additionally, it has been unexpectedly found that the low density particles which float to the water surface interact at the water-air interface along with the thin soap film on the individual particles to produce a rapid lathering action. Such action has been found to be very beneficial in literally foaming or releasing dirt and grime from a substrate such as human skin. High density abrasives, however, can be utilized as in industrial applications wherein clogging of drain traps and the like is not a problem.

The abrasive soap of the present invention does not relate to a physical admixture thereof, but rather to the aspect of the soap actually being formulated or attached to the various abrasive particles, that is, the soap particles are generally connected or fastened to the abrasive particles and hence form an integral abrasive soap particles. Not only is the soap formulated or attached to the various particles, but according to a method of preparation of the present invention, a dry powder is formed. That is, a dry flowable powdered soap is formed and thus the soap does not need to be dried through the use of auxiliary heating means such as an oven, infrared radiation, and the like.

However, it is to be understood that it is within the scope of the present invention that the abrasive soap particles can also be made such that a wet mass is produced such as by utilizing a liquid with either the initial or final precursor or both. Although a wet mixture may present production difficulties, when so produced it can be dried in any conventional manner as by heating in an oven, infrared radiation, sieving, subjected to convection, etc. The result, in either case, is a dry or neat powder abrasive soap with the reaction product of an acid or base component with an antipodal component on an abrasive particle.

The in-situ formation of the dry abrasive soap comprises applying to the abrasive particles an initial soap precursor or component and thereon reacting a second or final precursor or a different component. The abrasive particles, as noted above, can be of the same type of particles or different. That is, a plurality, blend or mixture, of different types of particles can be utilized.

An important aspect of the present invention is that the initial soap precursor be wet, or a liquid so that it can be applied to the abrasive and formulated, attached, lodged, or connected thereto as through surface tension, capillary action, etc. Accordingly, if not liquid at time of application, the initial precursor is heated to melt the same. The melting temperature is defined as a temperature which melts the initial precursor but is below the degradation temperature of said precursor. To avoid partial degradation, the melting temperature is desirably at least 10° F. below and more desirably at least 20° F. below the degradation temperature. Generally, the melting temperature of the first precursor is up to approximately 180° F., desirably up to about 150° F., and preferably up to about 130° F. or less.

The in-situ formation is the reaction product of an acid component and a base component. As noted above, to formulate, attach or connect the first precursor to the particle, it is applied thereto in generally a liquid state. The in-situ reaction thus occurs upon the particle surface and ensures that the formed soap is attached to the particle and forms an integral part thereof.

The first precursor is generally the acid component although it can be the base component. The acid component can be a naturally occurring component such that a so-called "natural" soap is formed, or a synthetic component. In other words, the source of the acid component can be derived from nature as from animal fats, various acid components of naturally occurring oils, plant fluids, and the like or from components which are synthetically prepared. By the term "acid component" it is meant any organic acid capable of making a soap.

Such soaps are well known to those skilled in the art as well as to the literature. More, specifically, the acid is an organic acid, such as a fatty acid or a fatty acid ester having a total of from 9 to 30 carbon atoms, desirably from 10 to 20 carbon atoms and preferably from 12 to 18 carbon atoms. The acids can be saturated, unsaturated, straight chained, branched, and/or contain hydroxyl functions thereon. Typically, natural sources are utilized in the preparation of the soaps and blends, i.e., combinations of two or more of various naturally occurring acids or synthetic acids can be utilized. Examples of various fatty acids include tallow, lard, tail oil, lanolin, coconut fatty acid, palm kernel oil, soya, rosin fatty acid, stearic acid, palmitic acid, myristic acid, oleic acid, linoleic acid, linolenic acid, behenic acid, isostearic acid, lauric acid, and the like. Preferred acids include tallow, tall oil, coconut fatty acid, stearic acid, oleic acid, lauric acid, myristic acid and the like. The fatty acid esters are often made from short-chain monohydric alcohols and long-chain fatty acids. The predominant alcohol generally utilized is isopropanol while examples of the acids include myristic acid, palmatic acid, stearic acid, lanolin fatty acids and the like. Examples of specific fatty acid esters thus include isopropyl myristate, isopropyl palmitate, and the like.

As noted above, the initial precursor is generally in the form of a liquid. Since some of the above acid components are not a liquid at ambient temperature, they must be heated to a suitable temperature to yield a wet or liquid component.

The application of the initial precursor to the various abrasive particles can be in any conventional manner as by spraying, or according to any general or conventional mixing method. For example, the various abrasives can be added to a vessel and mixed therein with the initial precursor added thereto. Alternatively, the initial precursor can be added to a vessel, heated if required in order to form a liquid, and the abrasive particles added thereto under mixing. The amount of initial precursor applied to the abrasive particle will in large part depend upon the type of particle, the smoothness or irregularity thereof, the particle size, porosity, desired amount of soap to be formed, the individual acid precursor, and the like. That is, rough particles can absorb or contain more of the initial precursor than smooth particles. Similarly, smaller particles contain greater surface area. A desired amount is such that the integral abrasive soap has suitable lathering properties upon use with water. Thus, with regard to skin care use, more lather is often desired and hence a large amount of soap formed on the particle is desired. With regard to use on hard substrates, less lather is often desired and in some situation very little or even nil lather can be utilized. In other words, the amount of soap formed on the abrasive particles can be tailor-made with regard to a suitable end use.

Generally, the amount of the initial precursor applied to the abrasive paticles is such that, with regard to skin care use, at least 60% of the surface area, desirably at least 80% and preferably from about 90% to 100% of the abrasive particle surface is covered.

When the end use is application to a hard substrate, an amount of soap utilized is usually such that from about 10% to about 100% and desirably from 20% to about 80% of the particle surface area is covered. Regardless of the amount of the surface covered, the amount of soap is such to yield a desired cleansing effect when utilized. As noted above, an unexpected cleaning effect is achieved when the light soap-abrasive particles float to the surface of water and rapidly form a lather with the air interface in a cleansing operation.

The initial precursor less desirably can be a base component. The base component can be any compound, natural or synthetic, which reacts with the acid component in-situ and forms a soap. Such compounds include conventional compounds as well as other compounds known to the art and to the literature. Examples of specific bases include the various alkaline hydroxides such as sodium hydroxide, potassium hydroxide, and the like. Other base type components include various amines such as alkanolamines having from 2 to 12 carbon atoms and desirably from 2 to 6 carbon atoms. Preferable alkanolamines include the mon-, di-, or trialkanolamines such as monoethanolamine, diethanolamine, triethanolamine, morpholine, and the like. Blends of various alkanolamines as well as aqueous dilutions thereof can naturally be utilized.

Once the initial precursor is added to the particles and applied thereto, the final precursor is added thereto with an in-situ reaction taking place on the surface of each abrasive particle. In other words, the formation of the soap is the in-situ reaction product of the base component and the acid component. The soap thus contains an acid portion and a base portion. Since the liquid precursor, when applied to the abrasive, will often fill various cracks, grooves, cavities, as well as be absorbed therein, the soap is often mechanically bonded to the abrasive. Should a sufficient amount of the various precursors be utilized, a coating is often formed about the entire particle. Inasmuch as the reaction of the acid component and the base component produces a solid reactant, a dry particle is typically formed. A plurality of such dry particles thus produce a dry powdered soap.

The in-situ formulated soap is a solid which is formed onto the surface of the solid abrasive particles. A dry, flowable, integral abrasive soap is accordingly produced. During the in-situ reaction, the components are thoroughly mixed to help ensure complete reaction of the soap components. Mixing is also important in that it assures uniformity of the product and the like. Should wet coated abrasive particles be produced as by adding an excessive amount of a liquid such as water or alcohol to the in-situ reaction mixture, the moisture can be removed as by heating and thus produced a dry or neat flowable powder. Drying can also be produced as by convection, that is, utilizing either ambient temperature or heated air, through the use of sieving or other conventional equipment which aids in removing liquid such as water.

The final precursor accordingly is the antipodal component, that is, if the initial precursor is the acid component, the final precursor is the base component. Similarly, should the initial precursor be the base component which is applied to the particles in a liquid state, the final component is then the acid component.

The abrasive soap produced is generally slightly alkaline and typically has a pH of from about 6.5 to about 10.0 and preferably from about 8.0 to about 9.0. It is to be understood that said pH represent an overall value and that individual portions or areas of the abrasive soap particle mixture can have a slightly higher or lower pH due to imperfect mixing and/or reaction. Accordingly, the amount of the base component utilized is generally from about 0.8 to about 1.1 equivalents, desirably from about 0.9 to about 1.05 equivalents, and desirably about 0.95 to 1.01 equivalents based upon each acid component equivalent.

It is important that the dry powdered abrasive soap of the present invention be free flowing. Although the in-situ reaction method of the present invention generally results in a dry powder, it may at times be desirable to add an anticaking agent to ensure good flowability of the product. Various conventional anticaking agents can be utilized such as talc, tricalcium phosphate, silicon dioxide, colloidal silicon dioxide, various polymers, powdered cellulose, magnesium stearate, calcium stearate, and the like. Various other anticaking agents can be utilized as known to the literature, for example as set forth in the yearly editions of McCutcheon's Functional Materials, the 1985 North American Edition, etc., and the like. The amount of this additive is usually small such as less than usually 5% by weight, desirably 4% or less and preferably 3% or less by weight based upon the total weight of the soap.

In addition to the above components, various common and conventional additives can be utilized in suitable or conventional amounts. Examples of such additives include preservatives, colorants, dyes, pigments, fragrances, emollients, thickeners, and the like. The total amount of such additives is generally small and usually in the range from about 0.01 percent to about 10 percent by weight and preferably from about 0.1 percent to about 2 percent or 3 percent by weight based upon a total weight of the in-situ product.

The addition or the mixing order of the various ingredients forming the in-situ reaction product of the present invention is generally not important. For example, the various abrasives can be initially added to a mixing vessel. the first precursor, which is usually the acid component, is then added thereto. These compounds are mixed utilizing a low-compacting stirrer or the like. If the first precursor is not a liquid or in a wet form, it can be heated either before adding, or in the presence of the abrasive. Various additions which are compatible with the first precursor can be added therewith. For example, if the first precursor is the acid component, various additives which are soluble with fatty acids can be added therewith or thereto such as the fragrances, the emollients, the preservatives, and the like.

The second precursor is then added and mixed in any conventional manner. Car is taken not to compact the abrasive mixture so as to produce a balled or agglomerated mixture and, in the case of a crushable abrasive such as perlite, not to crush the same. Generally, the second precursor is the base component. Along with the base component or added thereto are various additives which are water soluble. Such additives generally include the dyes, the thickeners, the water soluble preservatives, and the like.

Mixing is continued to ensure a uniform distribution of the second precursor and until the reaction is generally completed. The relative amount of the first and second precursors is as set forth above. Any remaining additives can be added either with or to the first precursor, with or to the second precursor, or thereafter. At times, it is desirable to add a small amount of water to facilitate the soap formation reactions and such liquid is generally added to the base compound. Any anticaking agents are generally added after the product has been formed.

As noted above, numerous different types of abrasives can be utilized as well as amounts thereof. When the end use of the product is for cleaning hard surfaces, the amount of abrasives in the powdered soap is generally higher than utilized with regard to skin cleaning uses. Generally, but not necessarily, for a hard surface end use, additional abrasives are added after formation of the product and exist in the form of free abrasives. The amount of such free abrasives added is from about 1 percent to about 45 percent and preferably from about 10 percent to about 20 percent.

An integral abrasive soap prepared according to the above in-situ method generally yields a dry, free flowing powder wherein the soap is securely coated to or attached to the various abrasive particles. Naturally, the process and composition can be varied to produce any desired end use characteristics. For example, uniformity of particle sizes as well as acid-base balance are generally desired.

The in-situ reaction product of the present invention can be utilized wherever soaps are utilized or an abrasive cleaning action is desired. Accordingly, the abrasive containing soaps can be utilized with regard to skin care as in the home, garage, factory or other industrial uses. In such cleaning operations a generally small size abrasive particle is desired. Perlite is especially desired since it is crushable and upon the application of a slight pressure thereto as in cleaning of hands, it is broken apart and yields a desirable scrubbing action. The soaps can be furthermore utilized on any hard substrate, for example, in the cleansing of various household items such as sinks, countertops, bathtubs, etc., or in the cleansing of various articles such as whitewall tires, tools, etc., and the like.

Although the in-situ formulation of an integral soap is preferred, an alternative method is to initially make the soap and subsequently apply it to the abrasive particles. In this procedure, soap is formed by reacting the initial precursor with the final precursor in a reaction vessel. The initial precursor, the final precursor, the various abrasive particles, and the like are all the same as set forth hereinabove. At least one component, that is, either the initial precursor or the final precursor must be liquid. Desirably, the reaction occurs in a liquid such as water. That is, the initial precursor such as the acid can be added to the vessel containing water. Thereafter, the base component such as the various amines is added thereto. The contents of the vessel can be heated to promote the reaction. The various abrasive particles can then be added to the reaction mixture and mixed therewith. Upon removal of the liquid, the formed soap will coat the abrasive particles. By coating, it is to be understood that a portion or the entire particle can be covered with the soap. The amount of water utilized can vary and normally is such to form a dilute solution. The evaporation or removal of the liquid can be carried out utilizing any conventional evaporation process. Although heat and infrared radiation can be utilized, other evaporation techniques can also be utilized such as sieving, convection evaporation, and the like. As the liquid, for example water, is removed, a coating is formed on the abrasive particles. The particles which may be agglomerated can be broken up utilizing any conventional method or apparatus such as by sieving, by screening, and the like.

The resultant product is, again, a dry or neat powder abrasive soap with the reaction product of an acid or base component with an antipodal component on an abrasive particle.

The invention will be better understood by reference to the following examples.

EXAMPLE I

Coconut/TEA - fine perlite

Procedures:

To prepare for the batch, melt 20.45% Coconut Fatty Acid (Emery 626). Weigh 66.03% fine perlite, (PFF-18 Pennsylvania Perlite). Premix: 12.00% Triethanolamine; 1.36% Soft Water, 0.095% of a 1% dye solution (Red #40 Warner Jenkinson). To compound the batch, pour the Coconut Fatty acid into a stainless steel mixing bowl. While mixing, add 0.055% perfume (Fragrance Resources 86F/192). Slowly add perlite with mixer on low speed. Mix approximately five minutes. Slowly add premix. Continue mixing for one hour at medium speed (stop mixer and toss with spatula at different intervals). Mix for one hour.

Product Description:

Light, free flowing powder, natural hand soap with good lathering characteristics. Rinses well leaving a non-greasy, non-tacky afterfeel on the skin.

EXAMPLE II

Coconut/Mono Ethanolamine - Perlite

Procedure:

To prepare for the batch, melt 37.57% Coconut Fatty Acid, (Emery 626). Weight 48.29% perlite (PFF-18). Premix: 9.36% Monoethanolamine; 2.50% Soft Water, 0.18%, of a 1% dye solution (Strawberry #7215). To compound the batch, pour the Coconut Fatty Acid into a stainless steel mixing bowl. While mixing, add 0.10% perfume (Fragrance Resources 86F/184). Slowly add perlite with mixer on low speed. Mix approximately five minutes, slowly add premix. Continue mixing for one hour at medium speed, (stop mixer and toss with spatula at different intervals). After one hour with mixer at low speed, add 2.0% talc 1731 (Whitaker, Clark and Danielson). Mix approximately ten minutes.

Product Description:

Light, free flowing powder, natural hand soap with good lathering characteristics. Rinses well leaving a non-greasy, non-tacky afterfeel on the skin.

EXAMPLE III

Coconut/TEA with Pulverized Linear low density Polyethylene

Procedure:

To prepare for the batch, melt 11.04% Coconut Fatty Acid (Emery 626). Weight 81.65% of the Polyethylene. Premix: 6.49% Triethanolamine; 0.736% Soft Water; 0.52% of a 1% dye solution (Red #40 Warner Jenkinson).

To compound the batch, pour the Coconut Fatty Acid into a stainless steel mixing bowl. While mixing, add 0.029% perfume (Fragrance Resources 86F/191). Slowly add polyethylene with mixer on low speed. Mix approximately five minutes. Slowly add premix. Continue mixing for one hour at medium speed (stop mixer and toss with spatula at different intervals). Mix for one hour.

Product Description:

Light, free flowing powder, natural hand soap with good lathering characteristics. Rinses well leaving a non-greasy, non-tacky afterfeel on the skin.

EXAMPLE IV

Linoleic/NaOH

Procedure:

To prepare for the batch, weigh 42.05% Linoleic Fatty Acid (Emersol 315 Emery). Weigh 51.92% medium perite, (PFF-18). Premix: 2.98% NaOH, 2.80% Soft Water, 0.196% of a 1% dye solution (Strawberry #7215).

To compound the batch, pour the linoleic fatty acid into a stainless steel mixing bowl. Slowly add perlite with mixer on low speed. Mix approximately five minutes. Slowly add premix. Continue mixing for one hour at medium speed (stop mixer and toss with spatula at different intervals). Mix for one hour.

Product Description:

Light, free flowing powder, natural hand soap. Rinses well leaving a non-greasy, non-tacky afterfeel on the skin.

EXAMPLE V

Coconut/Mono Ea, Medium Perlite with Drying Process

Procedure:

To prepare for batch, melt 14.33% Coconut Fatty Acid (Emery 626). Weigh 4.58% medium perilte (PFF-18). Premix: 78.86% Soft Water, 4.25% Monoethanolamine and 14.33% Coconut Fatty Acid. Pour into a stainless steel mixing bowl and mix until a thin soap solution is made. Slowly pour in the perlite. Mix until crushables are well coated in soap.

Transfer soap to electric fry pan; dry for 45 minutes to 1 hour at 250° F.

Product Description

Light, free flowing powder, natural hand soap with good lathering characteristics. Rinses well leaving a non-greasy, non-tacky afterfeel on the skin.

As apparent from the above Examples, abrasive containing soaps were prepared which were readily flowable and had good lathering properties and characteristics as well as uniformity and consistency. Thus, the integral formulation on the particles insures that a desirable combination of soap and abrasive is obtainable in any randomly selected quantity of the finished product.

While in accordance with the patent statutes, a best mode and preferred embodiment has been set forth in detail, the scope of the present invention is not limited thereto, but rather by the scope of the attached claims.

What is claimed is:

1. A free flowing soap powder, comprising:

the in-situ formation of a neat abrasive soap, said neat abrasive soap being the in-situ reaction product on abrasive particles of an initial precursor, selected from the group consisting of acid and base soap forming components and a final precursor selected from the group consisting of acid and base soap forming components, said final precursor being antipodal of said initial precursor; wherein said initial precursor is a liquid, said acid component is selected from the group consisting of fatty acids having from about 9 to about 30 carbon atoms and said base component is selected from the group consisting of morpholine and alkanolamines having from 2 to 12 carbon atoms;

said abrasive particles being present in an amount sufficient for said abrasive soap powder to be free flowing.

2. A free flowing integral abrasive soap powder according to claim 1, wherein said base component is an alkaline hydroxide or an amine compound, and wherein said abrasive is silica sand, aluminum oxide (corundum), pumice, rouge (iron oxide), feldspar, silicon carbide, boron carbide, cerium oxide, quartz, garnet, titanium dioxide, calcium carbonate, calcium phosphate, diatomaceous earth, perlite, kaolin, mica, tripoli, ridig polymeric materials, talc, vermiculite, water absorbent soft abrasives and combinations thereof.

3. A free flowing integral abrasive soap powder according to claim 2, wherein said fatty acid or fattya cid ester component contains from about 12 to about 18 carbon atoms and the amount of said base component is from about 0.8 to about 1.1 equivalents for each equivalent of said acid component, and wherein said abrasive is selected from the group consisting of limestone, pumice, diatomaceous earth, talc, vermiculite, plastic, perlite, and combinations thereof.

4. A free flowing integral abrasive soap powder according to claim 3 for use in skin care, said abrasive having a density of 0.9 grams/cc or less and a particle size of from about 150 to about 500 microns.

5. A free flowing integral abrasive soap powder according to claim 3, wherein said first precursor is said acid component, wherein the amount of said base component is from about 0.9 to about 1.05 equivalents for each equivalent of said acid component, wherein said amine base component is monoethanolamine, diethanolamine, triethanolamine, and combinations thereof.

6. A free flowing integral abrasive soap powder according to claim 5 for use on hard surfaces, said soap containing from about 1% to about 45% by weight of free abrasives therein based upon the total weight of the soap formulation.

7. A free flowing integral soap powder according to claim 5, wherein said abrasive is perlite.

8. A free flowing integral abrasive soap powder according to claim 7 for use in skin care, said abrasive having a density of 0.5 grams/cc or less.

9. A free flowing abrasive soap powder, comprising:

abrasive particles and a soap formed in-situ on said abrasive particles, wherein said soap contains an acid portion selected from the group consisting of fatty acids having from about 9 to about 30 carbon atoms and a base portion selected from the group consisting of morpholine and alkanolamines having from 2 to about 12 carbon atoms;

said abrasive particles being present in an amount sufficient for said abrasive soap powder to be free flowing.

10. A free flowing abrasive soap powder according to claim 9 for use on hard surfaces, said soap containing from about 1% to about 45% by weight of free abrasives therein based upon the total weight of the soap formulation.

11. A free flowing abrasive soap powder according to claim 9, wherein said abrasive is silica sand, aluminum oxide, pumice, rouge (iron oxide), feldspar, silicon carbide, boron carbide, cerium oxide, quartz, garnet, titanium dioxide, calcium carbonate, calcium phosphate, diatomaceous earth, perlite, kaolin, mica, tripoli, rigid polymeric materials, talc, vermiculite, water absorbent soft abrasives and combinations thereof.

12. A free flowing abrasive soap powder according to claim 11, wherein said fatty acid and said fatty acid ester has from about 12 to about 18 carbon atoms, wherein said alkanolamine has from about 2 to about 6 carbon atoms and wherein said abrasive is a plastic, diatomaceous earth, vermiculite, limestone, pumice, perlite and combinations thereof.

13. A free flowing abrasive soap powder according to claim 12, wherein said alkanolamine is selected from the group consisting of monoethanolamine, diethanolamine, triethanolamine, or combinations thereof, and wherein said abrasive is perlite.

14. A process for the in-situ formation of a soap on an abrasive particle to form a free flowing soap powder product, comprising the steps of:

applying an initial precursor to at least one type of an abrasive particle, and in-situ forming an integral abrasive soap powder by reacting said initial precursor with a final precursor, wherein said initial precursor is a liquid selected from the group consisting of acid and base soap forming components and said final precursor is selected from the group consisting of acid and base soap forming components and wherein said acid component is derived from a compound selected from the group consisting of fatty acids and fatty acid esters having from about 9 to about 30 carbon atoms, and said base component is selected from the group consisting of morpholine and alkanolamines having from 2 to 12 carbon atoms;

said abrasive particles being present in an amount sufficient for said abrasive soap powder to be free flowing.

15. A process according to claim 14, wherein said fatty acid or said fatty acid ester has from 12 to 18 carbon atoms, wherein said alkanolamine compound is selected from the group consisting of monoethanolamine, diethanolamine, triethanolamine, or combinations thereof, wherein said abrasive is selected from the group consisting of polymeric materials diatomaceous earth, vermiculite, limestone, pumice, perlite, and combinations thereof, wherein the particle size of said abrasives is from about 150 microns to about 500 microns, and wherein the amount of acid component is from about 0.9 to about 1.05 equivalents for every 1 equivalent of said base component.

16. The process of claim 14 wherein at least one of the percursors is a liquid, and excess moisture is removed by drying following application of the reaction mixture of said initial and said final percursors to said abrasive particle.

17. The process of claim 16 wherein said final percursor is a liquid and excess moisture is removed by drying following appication of the reaction mixture of said initial and said final percursor to said abrasive particle.

* * * * *

UNITED STATES PATENT AND TRADEMARK OFFICE

CERTIFICATE OF CORRECTION

PATENT NO. : 4,786,432

DATED : November 22, 1988

INVENTOR(S) : Kanfer et al.

It is certified that error appears in the above-identified patent and that said Letters Patent is hereby corrected as shown below:

In Column 1, Line 59, delete "ass" and substitute therefor --as--.

In Column 1, Line 60, delete "reltates" and substitute therefor --relates--.

In Column 3, Line 6, delete "the" and substitute therefor --The--.

In Column 3, Line 10, delete "rough" and substitute therefor --rouge--.

In Column 3, Line 20, delete "raolinite" and substitute therefor --kaolinite--.

In Column 3, Line 42, delete "formation" and substitute therefor --formulation--.

In Column 3, Line 60, delete "densied" and substitute therefor --desired--.

In Column 4, Lines 10-11, delete "particles" and substitute therefor --particle--.

In Column 5, Line 12, delete "tail" and substitute therefor --tall--.

In Column 6, Line 47, delete "produced" and substitute therefor --produce--.

UNITED STATES PATENT AND TRADEMARK OFFICE

CERTIFICATE OF CORRECTION

PATENT NO. : 4,786,432

DATED : November 22, 1988

INVENTOR(S) : Kanfer et al.

It is certified that error appears in the above-identified patent and that said Letters Patent is hereby corrected as shown below:

In Column 7, Line 34, delete the first "the" and substitute therefor --The--.

In Column 7, Line 46, delete "Car" and substitute therefor --Care--.

In Column 11, Line 8, delete "ridig" and substitute therefor --rigid--.

In Column 12, Line 59, delete "appication" and substitute therefor --application--.

UNITED STATES PATENT AND TRADEMARK OFFICE

CERTIFICATE OF CORRECTION

PATENT NO. : 4,786,432

DATED : November 22, 1988

INVENTOR(S) : Kanfer et al.

It is certified that error appears in the above-identified patent and that said Letters Patent is hereby corrected as shown below:

In Column 11, Lines 2 and 3, delete "an alkaline hydroxide or".

In Column 11, Lines 12 and 13, delete "or fattya cid ester".

In Column 12, Line 5, delete "and said fatty acid ester".

Signed and Sealed this

Ninth Day of May, 1989

*Attest:*

*Attesting Officer*

DONALD J. QUIGG

*Commissioner of Patents and Trademarks*